US011542653B2

(12) United States Patent
Civanelli et al.

(10) Patent No.: US 11,542,653 B2
(45) Date of Patent: Jan. 3, 2023

(54) FILTERLESS AIR-HANDLING SYSTEM FOR A HEAT PUMP LAUNDRY APPLIANCE

(71) Applicant: WHIRLPOOL CORPORATION, Benton Harbor, MI (US)

(72) Inventors: Claudio Civanelli, Travedona Monate (IT); Daniele Martinello, Besozzo (IT)

(73) Assignee: Whirlpool Corporation, Benton Harbor, MI (US)

( * ) Notice: Subject to any disclaimer, the term of this patent is extended or adjusted under 35 U.S.C. 154(b) by 35 days.

(21) Appl. No.: 16/920,776

(22) Filed: Jul. 6, 2020

(65) Prior Publication Data

US 2020/0332457 A1 Oct. 22, 2020

Related U.S. Application Data

(62) Division of application No. 15/293,870, filed on Oct. 14, 2016, now Pat. No. 10,738,411.

(51) Int. Cl.

| | |
|---|---|
| ***D06F 58/02*** | (2006.01) |
| ***D06F 58/20*** | (2006.01) |
| ***D06F 58/22*** | (2006.01) |
| ***D06F 58/24*** | (2006.01) |

(52) U.S. Cl.

CPC ..... *D06F 58/24* (2013.01); *D06F 58/206* (2013.01); *D06F 58/02* (2013.01); *D06F 58/22* (2013.01)

(58) Field of Classification Search

None

See application file for complete search history.

(56) References Cited

U.S. PATENT DOCUMENTS

| | | | |
|---|---|---|---|
| 2,515,825 | A | 7/1950 | Grant |
| 2,873,041 | A | 2/1959 | Allen |
| 2,934,023 | A | 4/1960 | Lamkin et al. |
| 3,196,553 | A | 7/1965 | Deaton et al. |
| 3,218,730 | A | 11/1965 | Menk et al. |
| 3,342,961 | A | 9/1967 | Deaton et al. |
| 3,653,807 | A | 4/1972 | Platt |
| 3,805,404 | A | 4/1974 | Gould |
| 3,953,146 | A | 4/1976 | Sowards |
| 3,999,304 | A | 12/1976 | Doty |
| 4,134,518 | A | 1/1979 | Menchen |
| 4,137,647 | A | 2/1979 | Clark, Jr. |
| 4,260,876 | A | 4/1981 | Hochheiser |

(Continued)

FOREIGN PATENT DOCUMENTS

| | | |
|---|---|---|
| CN | 101967746 | 2/2011 |
| CN | 101967746 A | 2/2011 |

(Continued)

*Primary Examiner* — Levon J Shahinian

(74) *Attorney, Agent, or Firm* — Price Heneveld LLP

(57) ABSTRACT

A laundry appliance includes a blower that directs process air along an airflow path. A condensing heat exchanger heats the process air to define heated process air. A drum receives the heated process air to dry laundry. A pump directs fluid along a fluid path. An evaporating heat exchanger cools the fluid to define a cooled fluid. A refrigerant circuit directs a refrigerant between the condensing and evaporating heat exchangers. A shower area in which the cooled fluid is showered through the heated process air after the heated process air exits the drum to wash particulate matter out of the heated process air. The pump directs the fluid towards the evaporating heat exchanger in order to cool the fluid, and directs the cooled fluid to the shower area.

20 Claims, 4 Drawing Sheets

(56) References Cited

U.S. PATENT DOCUMENTS 4,261,179 A 4/1981 Dageford
4,860,921 A 8/1989 Gidseg
4,870,735 A 10/1989 Jahr, Jr. et al.
5,285,664 A 2/1994 Chang et al.
5,600,966 A 2/1997 Valence et al.
5,628,122 A 5/1997 Spinardi
5,666,817 A 9/1997 Schulak et al.
5,720,536 A 2/1998 Jenkins et al.
5,927,095 A 7/1999 Lee
5,946,934 A 9/1999 Kim et al.
5,979,174 A 11/1999 Kim et al.
6,041,606 A 3/2000 Kim
6,073,458 A 6/2000 Kim
6,401,482 B1 6/2002 Lee et al.
6,598,410 B2 7/2003 Temmyo et al.
6,793,010 B1 9/2004 Manole
6,957,501 B2 10/2005 Park et al.
6,973,799 B2 12/2005 Kuehl et al.
6,983,615 B2 1/2006 Winders et al.
7,008,032 B2 3/2006 Chekal et al.
7,055,262 B2 6/2006 Goldberg et al.
7,093,453 B2 8/2006 Asan et al.
7,117,612 B2 10/2006 Slutsky et al.
7,127,904 B2 10/2006 Schmid
7,143,605 B2 12/2006 Rohrer et al.
7,162,812 B2 1/2007 Cimetta et al.
7,181,921 B2 2/2007 Nuiding
7,207,181 B2 4/2007 Murray et al.
7,254,960 B2 8/2007 Schmid et al.
7,504,784 B2 3/2009 Asada et al.
7,610,773 B2 11/2009 Rafalovich et al.
7,624,514 B2 12/2009 Konabe et al.
7,665,225 B2 2/2010 Goldberg et al.
7,707,860 B2 5/2010 Hong et al.
7,775,065 B2 8/2010 Ouseph et al.
7,866,057 B2 1/2011 Grunert et al.
7,895,771 B2 3/2011 Prajescu et al.
7,934,695 B2 5/2011 Sim et al.
7,980,093 B2 7/2011 Kuehl et al.
8,024,948 B2 9/2011 Kitamura et al.
8,056,254 B2 11/2011 Loffler et al.
8,074,469 B2 12/2011 Hamel et al.
8,079,157 B2 12/2011 Balerdi Azpilicueta et al.
8,099,975 B2 1/2012 Rafalovich et al.
8,104,191 B2 1/2012 Ricklefs et al.
8,166,669 B2 5/2012 Park et al.
8,182,612 B2 5/2012 Grunert
8,240,064 B2 8/2012 Steffens
8,245,347 B2 8/2012 Goldberg et al.
8,266,813 B2 9/2012 Grunert et al.
8,266,824 B2 9/2012 Steiner
8,276,293 B2 10/2012 Ricklefs et al.
8,377,224 B2 2/2013 Grunert
8,382,887 B1 2/2013 Alsaffar
8,434,317 B2 5/2013 Besore
8,438,750 B2 5/2013 Dittmer et al.
8,484,862 B2 7/2013 Nawrot et al.
8,572,862 B2 11/2013 TeGrotenhuis
8,601,830 B2 12/2013 Lee et al.
8,615,895 B2 12/2013 Shin et al.
8,656,604 B2 2/2014 Ediger et al.
8,667,705 B2 3/2014 Shin et al.
8,695,230 B2 4/2014 Noh et al.
8,770,682 B2 7/2014 Lee et al.
8,789,287 B2 7/2014 Kim et al.
8,789,290 B2 7/2014 Grunert
8,857,071 B2 10/2014 Lee et al.
8,910,394 B2 12/2014 Steffens
8,915,104 B2 12/2014 Beihoff et al.
8,984,767 B2 3/2015 Grunert et al.
9,010,145 B2 4/2015 Lim et al.
9,022,228 B2 5/2015 Grunert
9,027,256 B2 5/2015 Kim et al.
9,027,371 B2 5/2015 Beihoff et al.
9,052,142 B2 6/2015 Kim et al.
9,062,410 B2 6/2015 Ahn et al.
9,085,843 B2 7/2015 Doh et al.
9,103,569 B2 8/2015 Cur et al.
9,134,067 B2 9/2015 Ahn et al.
9,140,472 B2 9/2015 Shin et al.
9,140,481 B2 9/2015 Cur et al.
9,212,450 B2 12/2015 Grunert et al.
9,249,538 B2 2/2016 Bison et al.
9,299,332 B2 3/2016 Je
9,303,882 B2 4/2016 Hancock
9,328,448 B2 5/2016 Doh et al.
9,328,449 B2 5/2016 Doh et al.
9,334,601 B2 5/2016 Doh et al.
9,335,095 B2 5/2016 Bison et al.
9,356,542 B2 5/2016 Ragogna et al.
9,359,714 B2 6/2016 Contarini et al.
9,372,031 B2 6/2016 Contarini et al.
9,435,069 B2 9/2016 Contarini et al.
9,487,910 B2 11/2016 Huang et al.
9,506,689 B2 11/2016 Carbajal et al.
9,534,329 B2 1/2017 Contarini et al.
9,534,340 B2 1/2017 Cavarretta et al.
9,605,375 B2 3/2017 Frank et al.
9,644,306 B2 5/2017 Doh et al.
9,663,894 B2 5/2017 Kim et al.
2004/0139757 A1 7/2004 Kuehl et al.
2005/0217139 A1 10/2005 Hong
2005/0229614 A1 10/2005 Ansted
2006/0070385 A1 4/2006 Narayanamurthy et al.
2006/0144076 A1 7/2006 Daddis, Jr. et al.
2006/0196217 A1 9/2006 Duarte et al.
2007/0033962 A1 2/2007 Kang et al.
2008/0141699 A1 6/2008 Rafalovich et al.
2008/0196266 A1 8/2008 Jung et al.
2008/0307823 A1 12/2008 Lee et al.
2009/0071032 A1 3/2009 Kreutzfeldt et al.
2009/0158767 A1 6/2009 McMillin
2009/0158768 A1 6/2009 Rafalovich et al.
2009/0165491 A1 7/2009 Rafalovich et al.
2009/0260371 A1 10/2009 Kuehl et al.
2009/0266089 A1 10/2009 Haussmann
2010/0011608 A1 1/2010 Grunert et al.
2010/0101606 A1 4/2010 Grunert
2010/0107703 A1 5/2010 Hisano et al.
2010/0146809 A1 6/2010 Grunert et al.
2010/0154240 A1 6/2010 Grunert
2010/0212368 A1 8/2010 Kim et al.
2010/0230081 A1 9/2010 Becnel et al.
2010/0258275 A1 10/2010 Koenig et al.
2010/0288471 A1 11/2010 Summerer
2011/0011119 A1 1/2011 Kuehl et al.
2011/0030238 A1 2/2011 Nawrot et al.
2011/0036556 A1 2/2011 Bison et al.
2011/0072849 A1 3/2011 Kuehl et al.
2011/0209484 A1 9/2011 Krausch et al.
2011/0209860 A1 9/2011 Koenig et al.
2011/0277334 A1 11/2011 Lee et al.
2011/0280736 A1 11/2011 Lee et al.
2012/0017456 A1 1/2012 Grunert
2012/0266627 A1 10/2012 Lee
2012/0272689 A1 11/2012 Elger et al.
2013/0008049 A1 1/2013 Patil
2013/0104946 A1 5/2013 Grunert et al.
2013/0111941 A1 5/2013 Yu et al.
2013/0212894 A1 8/2013 Kim et al.
2013/0255094 A1 10/2013 Bommels et al.
2013/0263630 A1 10/2013 Doh et al.
2013/0276327 A1 10/2013 Doh et al.
2013/0318813 A1 12/2013 Hong et al.
2013/0340797 A1 12/2013 Bommels et al.
2014/0020260 A1 1/2014 Carow et al.
2014/0026433 A1 1/2014 Bison et al.
2014/0075682 A1 3/2014 Filippetti et al.
2014/0109428 A1 4/2014 Kim et al.
2014/0190032 A1 7/2014 Lee et al.
2014/0216706 A1 8/2014 Melton et al.
2014/0260356 A1 9/2014 Wu
2014/0290091 A1 10/2014 Bison et al.
2014/0366397 A1 12/2014 Wakizaka et al.

(56) References Cited

U.S. PATENT DOCUMENTS

| | | | |
|---|---|---|---|
| 2015/0015133 | A1 | 1/2015 | Carbajal et al. |
| 2015/0033806 | A1 | 2/2015 | Cerrato et al. |
| 2015/0114600 | A1 | 4/2015 | Chen et al. |
| 2015/0285551 | A1 | 10/2015 | Aiken et al. |
| 2015/0308034 | A1 | 10/2015 | Cavarretta et al. |
| 2015/0322618 | A1 | 11/2015 | Bisaro et al. |
| 2016/0010271 | A1 | 1/2016 | Shin et al. |
| 2016/0040350 | A1 | 2/2016 | Xu et al. |
| 2016/0083894 | A1 | 3/2016 | Bison et al. |
| 2016/0083896 | A1 | 3/2016 | Ryoo et al. |
| 2016/0115636 | A1 | 4/2016 | Kim et al. |
| 2016/0115639 | A1 | 4/2016 | Kim et al. |
| 2016/0138208 | A1 | 5/2016 | Bison et al. |
| 2016/0138209 | A1 | 5/2016 | Kitayama et al. |
| 2016/0145793 | A1 | 5/2016 | Ryoo et al. |
| 2016/0169540 | A1 | 6/2016 | Hancock |
| 2016/0178267 | A1 | 6/2016 | Hao et al. |
| 2016/0186374 | A1 | 6/2016 | Ryoo et al. |
| 2016/0258671 | A1 | 9/2016 | Allard et al. |
| 2016/0265833 | A1 | 9/2016 | Yoon et al. |
| 2016/0282032 | A1 | 9/2016 | Gomes et al. |
| 2016/0290702 | A1 | 10/2016 | Sexton et al. |
| 2016/0305696 | A1 | 10/2016 | Kobayashi et al. |
| 2016/0348957 | A1 | 12/2016 | Hitzelberger et al. |
| 2017/0037560 | A1 | 2/2017 | Shin et al. |

FOREIGN PATENT DOCUMENTS

| | | | |
|---|---|---|---|
| CN | 105177914 | | 12/2015 |
| CN | 105177914 | A | 12/2015 |
| CN | 105696291 | | 6/2016 |
| CN | 105696291 | A | 6/2016 |
| DE | 3147796 | | 3/1983 |
| DE | 3738031 | A1 | 5/1989 |
| DE | 4304372 | A1 | 8/1994 |
| DE | 4409607 | | 10/1994 |
| DE | 4409607 | A1 | 10/1994 |
| DE | 10002742 | C1 | 6/2001 |
| DE | 10116238 | B4 | 3/2005 |
| DE | 10002743 | B4 | 1/2006 |
| DE | 102005041145 | A1 | 3/2007 |
| DE | 102006018469 | A1 | 10/2007 |
| DE | 102007052835 | A1 | 5/2009 |
| DE | 102008033388 | A1 | 1/2010 |
| DE | 102008054832 | A1 | 7/2010 |
| DE | 102009046921 | | 5/2011 |
| DE | 102012223777 | A1 | 6/2014 |
| DE | 112012006737 | T5 | 4/2015 |
| EP | 468573 | A1 | 1/1992 |
| EP | 0816549 | | 1/1998 |
| EP | 0816549 | A2 | 1/1998 |
| EP | 999302 | A1 | 5/2000 |
| EP | 1055767 | A1 | 11/2000 |
| EP | 1987190 | A1 | 11/2008 |
| EP | 2134896 | B1 | 12/2009 |
| EP | 2189568 | A1 | 5/2010 |
| EP | 2202349 | | 6/2010 |
| EP | 2284310 | A1 | 2/2011 |
| EP | 2324152 | B1 | 5/2011 |
| EP | 2341178 | A1 | 7/2011 |
| EP | 2386679 | | 11/2011 |
| EP | 2455526 | A1 | 5/2012 |
| EP | 2466001 | | 6/2012 |
| EP | 2466001 | A1 | 6/2012 |
| EP | 2497856 | | 9/2012 |
| EP | 2497856 | A1 | 9/2012 |
| EP | 2559805 | A1 | 2/2013 |
| EP | 2581489 | A1 | 4/2013 |
| EP | 2612964 | A1 | 7/2013 |
| EP | 2612965 | A1 | 7/2013 |
| EP | 2612966 | A1 | 7/2013 |
| EP | 2634301 | | 9/2013 |
| EP | 2634301 | A1 | 9/2013 |
| EP | 2708636 | A1 | 3/2014 |
| EP | 2708639 | A1 | 3/2014 |
| EP | 2733257 | A1 | 5/2014 |
| EP | 2746455 | | 6/2014 |
| EP | 2746455 | A1 | 6/2014 |
| EP | 2594687 | | 9/2014 |
| EP | 2594687 | B1 | 9/2014 |
| EP | 2966215 | | 1/2016 |
| EP | 2993427 | A1 | 3/2016 |
| EP | 3015594 | A1 | 5/2016 |
| EP | 2468949 | | 6/2016 |
| EP | 2468949 | B1 | 6/2016 |
| EP | 3034675 | A1 | 6/2016 |
| EP | 3241944 | | 11/2017 |
| GB | 2087029 | A | 5/1982 |
| JP | 2000018796 | | 1/2000 |
| JP | 2004053055 | | 2/2004 |
| JP | 2005027768 | | 2/2005 |
| JP | 2006017338 | | 1/2006 |
| JP | 2006187449 | | 7/2006 |
| JP | 2008259665 | | 10/2008 |
| JP | 2013019623 | A | 1/2013 |
| JP | 2013085687 | | 5/2013 |
| KR | 20100031929 | A | 3/2010 |
| KR | 20110125570 | | 11/2011 |
| NL | 7801958 | A | 8/1979 |
| WO | 8602149 | | 4/1986 |
| WO | 2004106737 | A1 | 12/2004 |
| WO | 2005001357 | A1 | 1/2005 |
| WO | 2005032322 | A2 | 4/2005 |
| WO | 2007013327 | A1 | 2/2007 |
| WO | 2007093461 | A1 | 8/2007 |
| WO | 2008077708 | A1 | 7/2008 |
| WO | 2008110451 | A1 | 9/2008 |
| WO | 2008151938 | A1 | 12/2008 |
| WO | 2009031812 | A2 | 3/2009 |
| WO | 2009059874 | A1 | 5/2009 |
| WO | 2009077226 | A1 | 6/2009 |
| WO | 2009077227 | A1 | 6/2009 |
| WO | 2009077291 | A1 | 6/2009 |
| WO | 2009089460 | A2 | 7/2009 |
| WO | 2010028992 | A1 | 3/2010 |
| WO | 2010040635 | A1 | 4/2010 |
| WO | 2010071355 | A2 | 6/2010 |
| WO | 2010102892 | A1 | 9/2010 |
| WO | 2010112321 | A1 | 10/2010 |
| WO | 2010118939 | A1 | 10/2010 |
| WO | 2011057954 | A2 | 5/2011 |
| WO | 2011061068 | A1 | 5/2011 |
| WO | 2012022655 | | 2/2012 |
| WO | 2012022803 | A1 | 2/2012 |
| WO | 2012065916 | A1 | 5/2012 |
| WO | 2012093059 | A1 | 7/2012 |
| WO | 2012101028 | A1 | 8/2012 |
| WO | 2012134149 | A2 | 10/2012 |
| WO | 2012138136 | A2 | 10/2012 |
| WO | 2013129779 | A1 | 9/2013 |
| WO | 2013144763 | A2 | 10/2013 |
| WO | 2013144764 | A1 | 10/2013 |
| WO | 2014001950 | A1 | 1/2014 |
| WO | 2014040923 | A1 | 3/2014 |
| WO | 2014041097 | A1 | 3/2014 |
| WO | 2014076149 | A1 | 5/2014 |
| WO | 2014095790 | A1 | 6/2014 |
| WO | 2014102073 | A1 | 7/2014 |
| WO | 2014102144 | A1 | 7/2014 |
| WO | 2014102317 | A2 | 7/2014 |
| WO | 2014102322 | A1 | 7/2014 |
| WO | 2014154278 | | 10/2014 |
| WO | 2014154278 | A1 | 10/2014 |
| WO | 2015003742 | A1 | 1/2015 |
| WO | 2015028270 | A1 | 3/2015 |
| WO | 2015074837 | A1 | 5/2015 |
| WO | 2015082011 | A1 | 6/2015 |
| WO | 2015101386 | A1 | 7/2015 |
| WO | 2015101387 | A1 | 7/2015 |
| WO | 2015101388 | A1 | 7/2015 |
| WO | 2015101892 | A1 | 7/2015 |
| WO | 2015160172 | A1 | 10/2015 |
| WO | 2016006900 | A1 | 1/2016 |
| WO | 2016020852 | | 2/2016 |

(56) References Cited

FOREIGN PATENT DOCUMENTS

| | | | |
|---|---|---|---|
| WO | 2016020852 | A1 | 2/2016 |
| WO | 2016045173 | | 3/2016 |
| WO | 2016085432 | | 6/2016 |
| WO | 2016095970 | | 6/2016 |
| WO | 2016150660 | A1 | 9/2016 |
| WO | 2016204414 | | 12/2016 |
| WO | 2017023122 | | 2/2017 |

FILTERLESS AIR-HANDLING SYSTEM FOR A HEAT PUMP LAUNDRY APPLIANCE

CROSS-REFERENCE TO RELATED APPLICATION

The present application is a divisional of U.S. patent application Ser. No. 15/293,870, now U.S. Pat. No. 10,738,411, filed Oct. 14, 2016, entitled FILTERLESS AIR-HANDLING SYSTEM FOR A HEAT PUMP LAUNDRY APPLIANCE, the entire disclosure of which is hereby incorporated herein by reference.

BACKGROUND

The device is in the field of laundry appliances, and more specifically, laundry appliances having a heat pump system for operating a filterless air-handling system.

SUMMARY

In at least one aspect, a laundry appliance includes a blower that directs process air along an airflow path. A condensing heat exchanger heats the process air to define heated process air. A drum receives the heated process air to dry laundry. A pump directs fluid along a fluid path. An evaporating heat exchanger cools the fluid to define a cooled fluid. A refrigerant circuit directs a refrigerant between the condensing and evaporating heat exchangers. A shower area in which the cooled fluid is showered through the heated process air after the heated process air exits the drum to wash particulate matter out of the heated process air. The pump directs the fluid towards the evaporating heat exchanger in order to cool the fluid, and directs the cooled fluid to the shower area.

In at least another aspect, a thermal exchange system for an appliance includes a first heat exchange loop having condensing and evaporating heat exchangers. A second heat exchange loop heats process air at the condensing heat exchanger for delivery through a drum and a shower area, sequentially. A third heat exchange loop cools a fluid at the evaporating heat exchanger for delivery to the shower area. The shower area is defined by an interaction of the fluid with the process air leaving the drum to wash particulate matter from the process air leaving the drum and to cool and dehumidify the process air leaving the drum.

In at least another aspect, an air-handling system for an appliance includes an airflow path that directs process air through a condensing heat exchanger to define heated process air that is delivered through a rotating drum. A fluid path selectively directs a fluid through an evaporating heat exchanger to define cooled fluid, wherein the evaporating heat exchanger is in thermal communication with the condensing heat exchanger. A shower area defined by an intersection of the airflow path and the fluid path. The cooled fluid is delivered through the heated process air within the fluid shower to cool and dehumidify the heated process air and warm the cooled fluid. The cooled fluid washes particulate matter from the heated process air. The heated process air increases a fluid temperature of the cooled fluid.

These and other features, advantages, and objects of the present device will be further understood and appreciated by those skilled in the art upon studying the following specification, claims, and appended drawings.

DETAILED DESCRIPTION OF EMBODIMENTS

Figure 1:
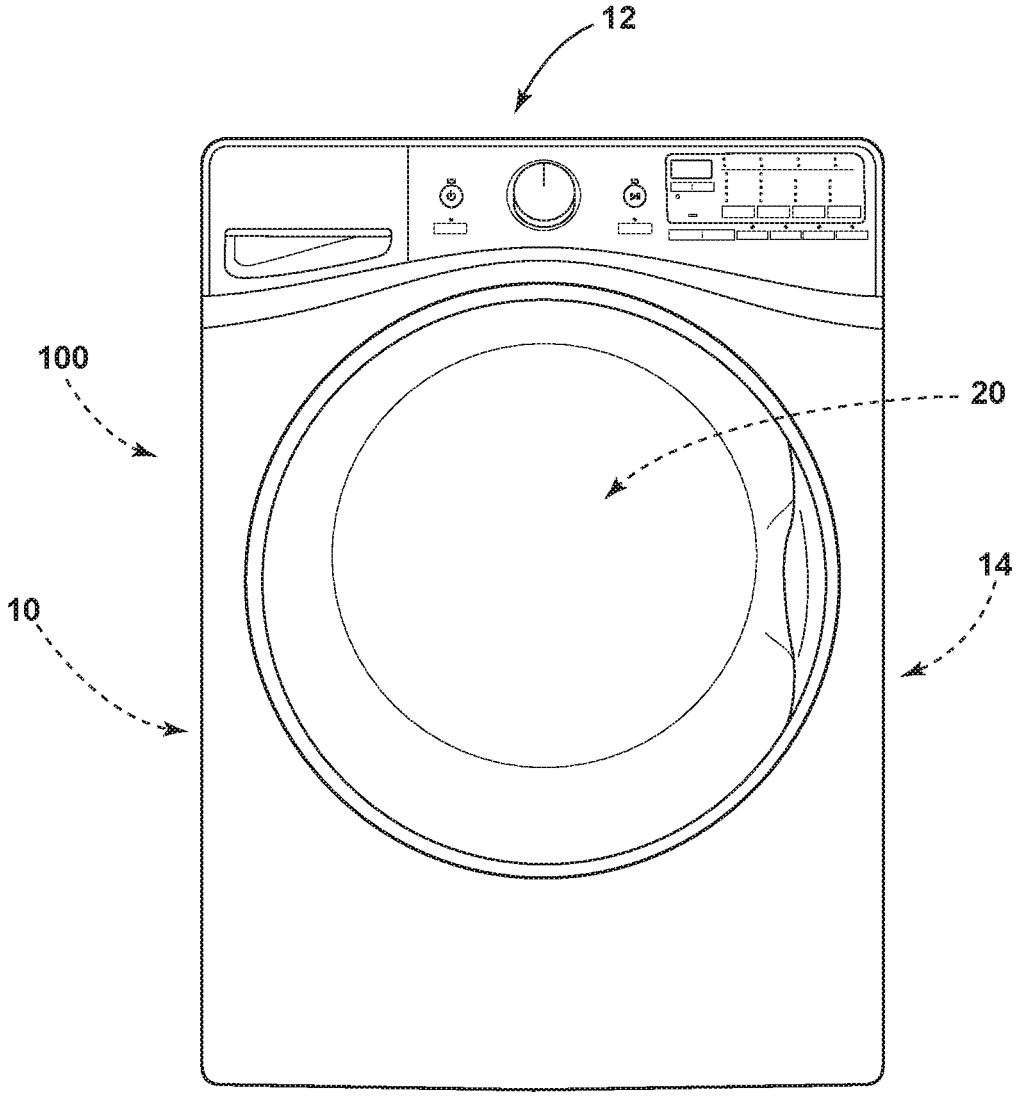
FIG. 1 is a front elevational view of a laundry appliance incorporating an aspect of the filterless air-handling system used in conjunction with a heat pump.
Figure 2:
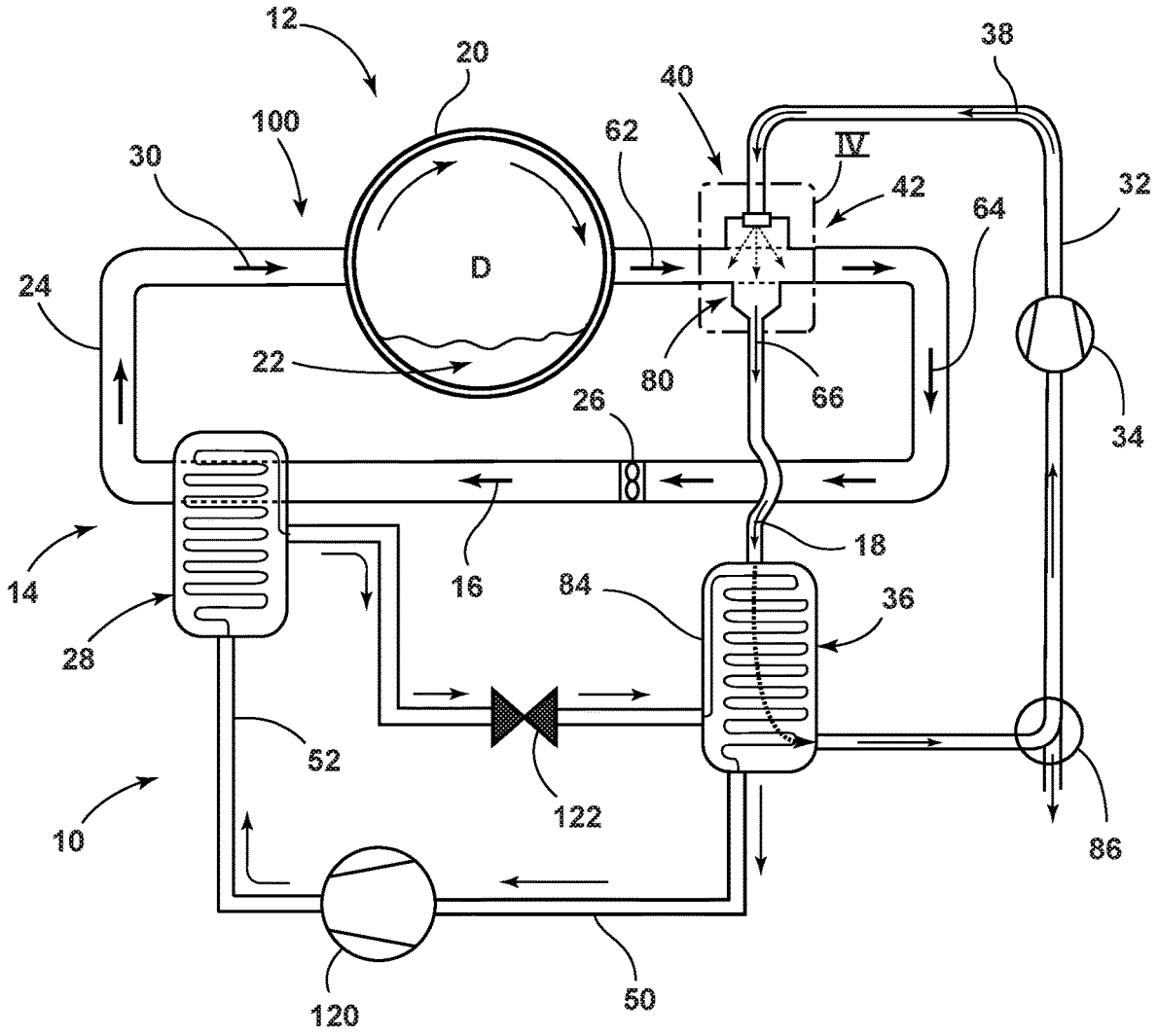
FIG. 2 is a schematic diagram illustrating an aspect of the heat pump and air-handling systems for a laundry appliance.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As illustrated in FIGS. 1-5, reference numeral 10 generally refers to a heat pump system for operating a laundry appliance 12, where the laundry appliance 12 can be a washer, dryer or combination washer and dryer. The heat pump system 10 for the appliance 12 can be used as a thermal exchange system 14 for heating and cooling process air 16 and fluid 18, typically water, for use in performing the various laundry functions of the appliance 12. The laundry appliance 12 can include a rotating drum 20 for receiving one or more items 22 to be processed. An airflow path 24 of the appliance 12 includes a blower 26 that directs process air 16 through the rotating drum 20. The airflow path 24 is configured to intersect with a first heat exchanger, typically in the form of a condensing heat exchanger 28, that selectively increases an air temperature 112 of the process air 16 to define heated process air 30 that is selectively delivered through the rotating drum 20. A fluid path 32 includes a fluid pump 34 that directs fluid 18 to intersect with a second heat exchanger, typically in the form of an evaporating heat exchanger 36. The evaporating heat exchanger 36 selectively decreases the fluid temperature 114 of the fluid 18 to define a cooled fluid 38 that is delivered to a shower area 40. It is contemplated that the heated process air 30 and the cooled fluid 38 selectively intersect within the shower area 40 to define a third heat exchanger 42, typically in the form of the shower area 40 having a sprayer. Within this third heat exchanger 42, the cooled fluid 38 is heated by the heated process air 30 passing through the shower area 40. Simultaneously, the heated process air 30 is cooled by the cooled fluid 38 that passes through the shower area 40.

Referring again to FIGS. 1-5, the appliance 12 also includes a refrigerant circuit 50 that directs a refrigerant 52 between the condensing and evaporating heat exchangers 36. It is contemplated that the airflow path 24 and the process air 16 are free of direct engagement with the evaporating heat exchanger 36 and the fluid path 32 and the fluid 18 are free of direct engagement with the condensing heat exchanger 28.

Referring again to FIGS. 2-5, during operation of the appliance 12, the heated process air 30 is adapted to selectively extract moisture 60 from the items 22, such as damp fabric, within the rotating drum 20 to define moisture-laded process air 62 that is delivered to the shower area 40. As the moisture-laden process air 62 passes through the shower area 40, the cooled fluid 38 is sprayed into the shower area 40 to intermingle with the moisture-laden process air 62. The cooled fluid 38 decreases the air temperature 112 of the moisture-laden process air 62 and serves to condense and remove the moisture 60 from the moisture-laden process air 62. The process air 16 leaving the shower area 40, through the intermingling with the cooled fluid 38, is dehumidified to define a cool return air 64 that is returned to the condensing heat exchanger 28. The cool return air 64 includes less moisture, and, as will be described more fully below, less particulate matter 82, than that of the moisture-laden process air 62. Additionally, the intermingling of the moisture-laden process air 62 and the cooled fluid 38, raises the fluid temperature 114 of the cooled fluid 38 to define a heated return fluid 66 containing the condensed moisture 60 and particulate matter 82 that is directed back toward the evaporating heat exchanger 36.

Referring again to FIGS. 2-5, it is contemplated that the shower area 40, while serving to provide various moisture condensing functions to the moisture-laden process air 62, also defines a particulate filtration mechanism 80. This particulate filtration mechanism 80 serves to remove particulate matter 82 contained within the moisture-laden process air 62 by passing the cooled fluid 38 through the moisture-laden process air 62. Accordingly, the fluid 18 is showered through the moisture-laden process air 62 to wash out particulate matter 82 therefrom without the need for a screen, fabric sponge or other similar filter. The intersection of the cooled fluid 38 with the moisture-laden process air 62 serves to washout or otherwise capture various particulate matter 82 present within the moisture-laden process air 62. This particulate matter 82 is typically captured from the items 22 being processed in the rotating drum 20. In this manner, the heated return fluid 66 can include condensed moisture 60 that has been captured from the moisture-laden process air 62 and also the particulate matter 82 captured therefrom as well.

According to the various embodiments, it is contemplated that the heated return fluid 66 can be transmitted to a fluid tank 84 for recycling back through the evaporating heat exchanger 36 to be cooled into the cooled fluid 38 and subsequently pumped back to the shower area 40. It is also contemplated that during or after the performance of various laundry functions, the heated return fluid 66 containing the condensate and particulate matter 82 from the moisture-laden process air 62 can be removed from the appliance 12 through a drain 86 and/or drain pump or through removal of a removable compartment having the particulate matter 82 and fluid 18 contained therein. Through this operation of the particulate filtration mechanism 80, the cooled return air is substantially free of particulate matter 82 that may adhere to the condensing heat exchanger 28.

Referring again to FIGS. 1-5, the appliance 12 can include an air-handling system 100 where the airflow path 24 is directed through the rotating drum 20. The airflow path 24 is adapted to selectively direct process air 16 through the first heat exchanger that corresponds to the condensing heat exchanger 28. As the process air 16 moves through the condensing heat exchanger 28, the process air 16 is heated to define the heated process air 30 that is delivered through the rotating drum 20. This heated process air 30 serves to collect moisture 60 present within the wet or damp items 22, such as damp or wet clothing, contained therein. The fluid path 32 of the air-handling system 100 is adapted to selectively direct the fluid 18 through the second heat exchanger that corresponds to the evaporating heat exchanger 36. It is contemplated that the evaporating heat exchanger 36 is in thermal communication with the condensing heat exchanger 28, such as through the refrigerant circuit 50 or through some other thermal exchange mechanism defined between the condensing and evaporating heat exchangers 36. As the fluid 18 passes through the evaporating heat exchanger 36, the fluid 18 is cooled to define the cooled fluid 38 that is directed to the shower area 40.

According to the various embodiments, as exemplified in FIGS. 2-5, the air-handling system 100 includes the shower area 40 that is defined by an intersection of the airflow path 24 and the fluid path 32. Within this intersection, the cooled fluid 38 is selectively passed through the heated process air 30 within the shower area 40. Accordingly, the shower area 40 defines the third heat exchanger 42 that selectively transfers heat energy 110 from the heated process air 30 to the cooled fluid 38 to decrease the air temperature 112 of the heated process air 30 and simultaneously increase the fluid temperature 114 of the cooled fluid 38. As discussed above, this transfer of heat energy 110 can also serve to condense moisture 60 that has been captured by the heated process air 30 moving through the rotating drum 20. In this manner, the air leaving the rotating drum 20 can be defined as moisture-laden process air 62. The cooled fluid 38 passing through the moisture-laden process air 62 decreases the air temperature 112 of, and condenses the moisture 60 within, the moisture-laden process air 62. This condensed and removed moisture 60 can be delivered by the heated return fluid 66 to the fluid tank 84 for reuse within the fluid path 32. This moisture 60 can also be drained or otherwise removed from the appliance 12.

Referring again to FIGS. 2 and 3, it is contemplated that the evaporating heat exchanger 36 is dedicated for use in conjunction with the fluid path 32 and the fluid 18 delivered to the shower area 40. Accordingly, the evaporating heat exchanger 36 is free of direct contact with the airflow path 24 and the process air 16 moving therethrough. It is also contemplated that the condensing heat exchanger 28 is dedicated for use in connection with the airflow path 24 and the process air 16 moving therethrough to heat the air that is delivered to the rotating drum 20. Accordingly, the condensing heat exchanger 28 is free of direct contact with the fluid path 32 and the fluid 18 moved therethrough. It is contemplated that the condensing and evaporating heat exchangers 28, 36 do have indirect thermal communication with the fluid path 32 and airflow path 24, respectively, through the intersection of the process air 16 and fluid 18 within the shower area 40 that defines the third heat exchanger 42. This point of intersection at the third heat exchanger 42 is distal from the condensing and evaporating heat exchangers 28, 36.

According to the various embodiments, it is contemplated that the condensing and evaporating heat exchangers 28, 36 can be connected through a refrigerant circuit 50 that selectively delivers a refrigerant 52 between the condensing and evaporating heat exchangers 28, 36. Such a refrigerant circuit 50 can include a compressor 120, an expansion device 122, and the refrigerant 52 that can include a phase change material, such as Freon, water, and other similar phase change materials.

According to the various embodiments, in order to move the process air 16 through the airflow path 24 and the fluid 18 through the fluid path 32, the airflow path 24 can include a blower 26 that selectively recirculates process air 16 sequentially through the rotating drum 20, the shower area 40 and the condensing heat exchanger 28. The fluid path 32 can include a fluid pump 34 that selectively delivers fluid 18 from the second heat exchanger and to the shower area 40. It is contemplated that the fluid 18 can be delivered from the shower area 40 back to a fluid tank 84 and/or the evaporating heat exchanger 36 through the force of gravity or a secondary pump positioned within the fluid path 32.

Referring again to FIGS. 1-5, it is contemplated that the heat pump system 10 for the appliance 12 can be part of a thermal exchange system 14 that transfers heat energy 110 throughout various portions of the appliance 12. In this manner, the thermal exchange system 14 can be used for performing certain functions of the appliance 12 during treatment of various items 22 within the rotating drum 20. Such items 22 can include, but are not limited to, fabric, clothing, dishes, utensils and other similar items 22 that can vary depending on the nature of the appliance 12. It is contemplated that the thermal exchange system 14 can include a first heat exchange loop 130 that includes a first thermal transfer material 132 that is selectively delivered through the first and second heat exchangers. The thermal exchange system 14 can also include a second heat exchange loop 134 having a second thermal transfer material 136. This second thermal transfer material 136 is selectively delivered through the first heat exchanger (in the form of the condensing heat exchanger 28) and the third heat exchanger 42. It is contemplated that the second thermal transfer material 136 is selectively directed through a process chamber 138, such as a rotating drum 20, a stationary tub, an interior cavity, combinations thereof, and other similar interior processing spaces.

Referring again to FIGS. 2-5, within the process chamber 138, the second thermal transfer material 136 is adapted to extract and retain, at least temporarily, moisture 60 present within the process chamber 138. A third heat exchange loop 140 of the thermal exchange system 14 includes a third thermal transfer material 142. This third thermal transfer material 142 is selectively delivered through the second heat exchanger, in the form of the evaporating heat exchanger 36 and third heat exchanger 42.

According to the various embodiments, the third heat exchanger 42 is defined by the intersection of the second and third thermal transfer materials 136, 142. Additionally, the third thermal transfer material 142 is adapted to condense and precipitate the retained moisture 60 within the second thermal transfer material 136 and to remove at least a portion of the particulate matter 82 sequestered or otherwise retained within the second thermal transfer material 136.

It is contemplated that the second thermal transfer material 136 of the second heat exchange loop 134 can be process air 16 that is directed through the process chamber 138. The third thermal transfer material 142 can be the fluid 18 that is directed through the fluid sprayer 144 disposed proximate the third heat exchanger 42. In this embodiment, the second heat exchange loop 134 passes through the first heat exchanger, which again corresponds to the condensing heat exchanger 28. This condensing heat exchanger 28 heats the process air 16 to define the heated process air 30 that is delivered through the process chamber 138, typically in the form of the rotating drum 20. As the heated process air 30 moves through the third heat exchanger 42, this third heat exchanger 42 at least partially performs an evaporating function to cool the process air 16 and also condense moisture 60 contained within the process air 16. Accordingly, with respect to the second heat exchange loop 134, the third heat exchanger 42 acts as an evaporator 150 for the second heat exchange loop 134.

With respect to the third heat exchange loop 140, the fluid 18 pumped therethrough is cooled by the second heat exchanger, which typically corresponds to the evaporating heat exchanger 36. This cooled fluid 38 is directed to the fluid sprayer 144 of the third heat exchanger 42. With respect to the third heat exchange loop 140, the third heat exchanger 42 performs certain condensing functions such that the cooled fluid 38 is heated as it passes through the third heat exchanger 42. Accordingly, with respect to the third heat exchange loop 140, the third heat exchanger 42 is a condenser 152 that operates in conjunction with the evaporating heat exchanger 36 of the first heat exchange loop 130. In this manner, the third heat exchanger 42 of the thermal exchange system 14 of the appliance 12 simultaneously performs both condensing functions with respect to the third heat exchange loop 140 and evaporating functions with respect to the second heat exchange loop 134. In such an embodiment, the condensing, evaporating and third heat exchangers 28, 36, 42 of the thermal exchange system 14 transfer heat energy 110 in the form of heating and cooling to perform various processing functions of the appliance 12.

Stated another way, the condensing and third heat exchangers 28, 42 of the thermal exchange system 14 define a heater 160 and a cooling module 162, respectively, of the second heat exchange loop 134. Simultaneously, the evaporating and third heat exchangers 36, 42 define a cooling module 162 and a heater 160, respectively, of the third heat exchange loop 140.

Figure 3:
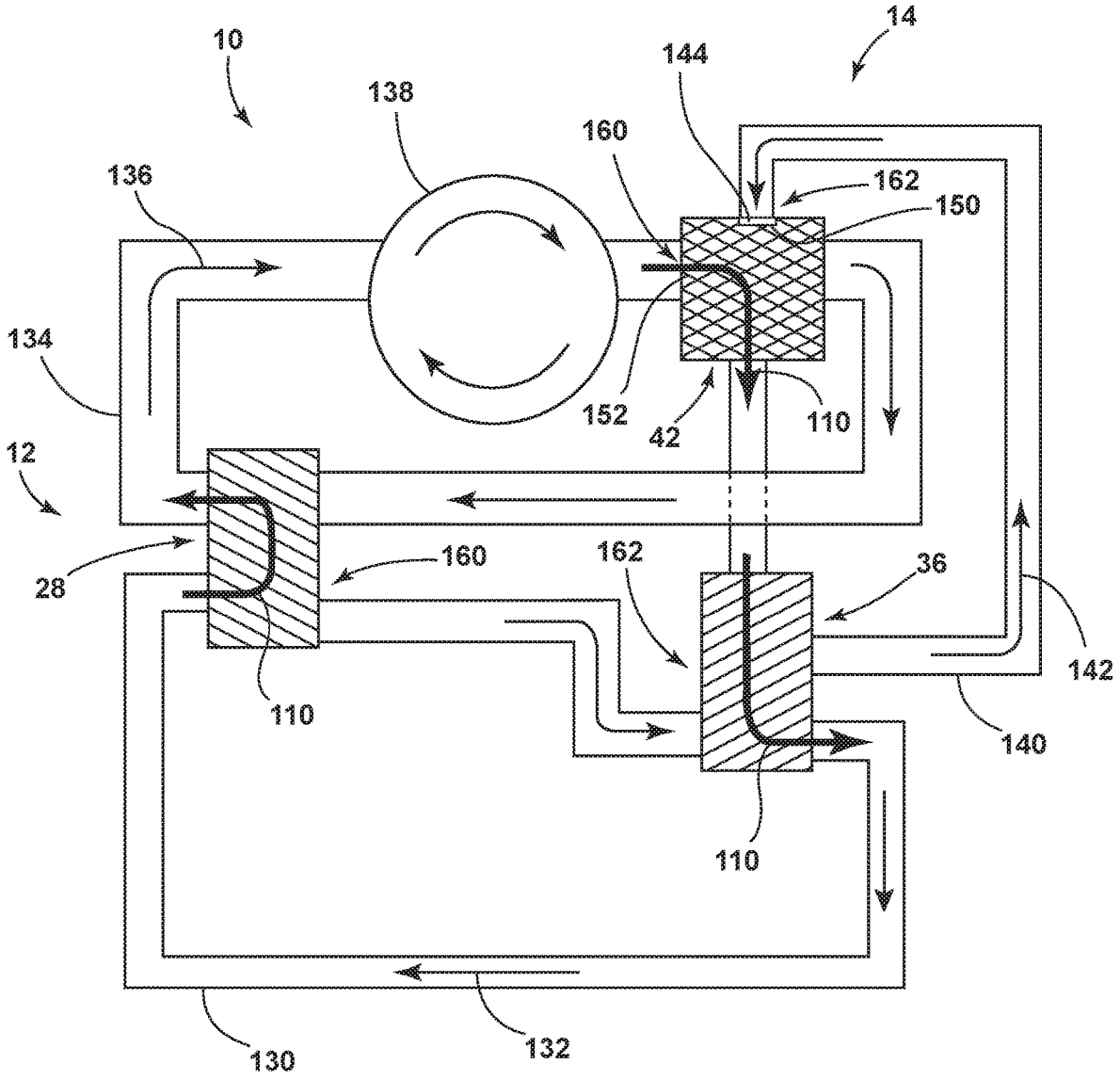
FIG. 3 is a schematic diagram illustrating operation of an aspect of the heat exchange loops for the thermal exchange system for the laundry appliance.
Figure 4:
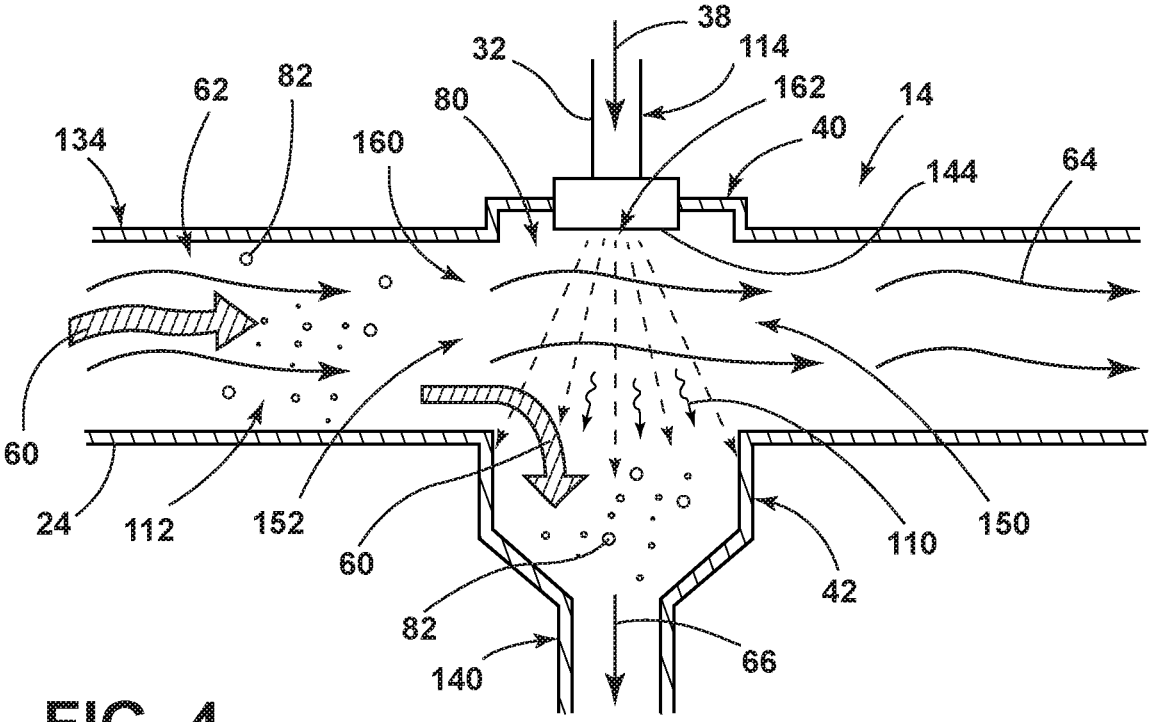
FIG. 4 is a schematic diagram of the appliance of FIG. 2 taken at area IV and illustrating operation of the third heat exchanger.
Figure 5:
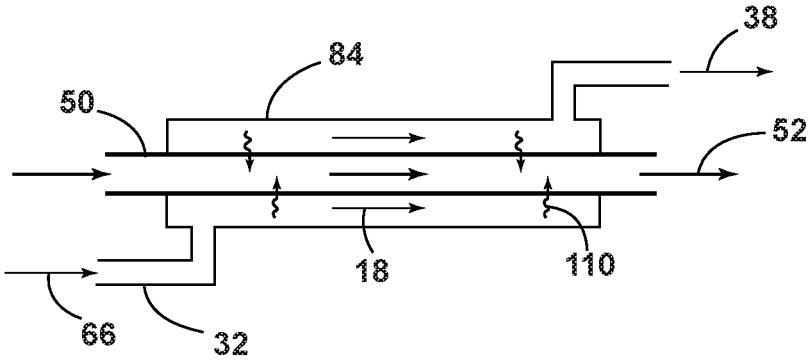
FIG. 5 is a schematic diagram illustrating operation of the second heat exchanger of the appliance of FIG. 2.

According to the various embodiments, as exemplified in FIGS. 3-5, this continual transfer of heat energy 110 via the condensing, evaporating and third heat exchangers 28, 36, 42 of the thermal exchange system 14 for the appliance 12 efficiently utilizes the heating and cooling capacities of the condensing and evaporating heat exchangers 36 to perform the various washing and/or drying functions of the laundry appliance 12. Through the use of the thermal exchange system 14, heat energy 110 is transferred within the condensing heat exchanger 28 from the first thermal transfer material 132, typically a refrigerant 52, to the second thermal transfer material 136, typically the process air 16. Substantially all of this heat energy 110 is subsequently transferred again at the third heat exchanger 42 from the second thermal transfer material 136 to the third thermal transfer material 142, typically the fluid 18. As discussed above, this transfer of heat energy 110 within the third heat exchanger 42 performs the condensation and particulate filtration functions of the thermal exchange system 14. The heat energy 110 within the third thermal transfer material 142 is then transferred back to the first thermal transfer material 132 within the evaporating heat exchanger 36. This transfer of heat energy 110 between the condensing, evaporating and third heat exchangers 28, 36, 42 serves to conserve energy and makes the appliance 12 generally more efficient.

Referring again to FIG. 4, within the third heat exchanger 42, heat energy 110 within the process air 16 obtained from the condensing heat exchanger 28 is mingled with cooling contained within the cooled fluid 38. As discussed above, the cooling is generated by the extraction of heat from the fluid 18 at the evaporating heat exchanger 36. As discussed above, this mingling of the moisture-laden process air 62 with the cooled fluid 38 produces condensation and precipitation of moisture 60 within the moisture-laden process air 62. This removal of moisture 60 allows for the process air 16 to be recirculated through the condensing heat exchanger 28 and returned to the rotating drum 20 to capture additional moisture 60 from the items 22 being processed within the rotating drum 20.

According to the various embodiments, this removal of moisture 60 within the third heat exchanger 42 is possible through the separation of the process air 16 from direct contact with the evaporating heat exchanger 36. Instead, cooling, in the form of cooled fluid 38, from the evaporating heat exchanger 36 is delivered to the fluid sprayer 144 of the third heat exchanger 42. The cooled fluid 38 performs the evaporating functions to remove moisture 60 and particulate matter 82 with respect to the moisture-laden process air 62. Additionally, this condensing operation is also possible through the separation of the fluid path 32 from direct engagement with the condensing heat exchanger 28. Accordingly, the moisture condensation functions and particulate filtration, with respect to the moisture-laden air, as discussed above, are physically separated from both of the condensing and evaporating heat exchangers 28, 36.

According to the various embodiments, by separating the moisture condensation and particulate removal functions of the appliance 12 with respect to the moisture-laden process air 62 from each of the condensing and evaporating heat exchangers 28, 36, the particulate filtration mechanism 80 of the laundry appliance 12 can also be contained within the third heat exchanger 42, and physically separated from the condensing and evaporating heat exchangers 28, 36. By removing the particulate matter 82, such as lint, fluff, and other fibrous material obtained from the items 22 being processed within the rotating drum 20, this material is removed from the process air 16 before the process air 16 is returned to the condensing heat exchanger 28. This particulate matter 82 can also be removed from the fluid 18 before the fluid 18 is returned to the evaporating heat exchanger 36. Accordingly, this heat pump system 10 described herein allows for the absence of a screen-type filter while also unifying the filtration and moisture condensing functions of the appliance 12 within a single location of the third heat exchanger 42. In this manner, the third heat exchanger 42 is a compartment or area within the appliance 12 where process air 16 and fluid 18 can be combined to transfer heat energy 110 therebetween.

According to the various embodiments, the thermal exchange system 14 described herein can be incorporated within various appliances 12. These appliances 12 can include, but are not limited to, washers, dryers, combination washers and dryers, refrigerators, dish washers, freezers, and other similar appliances 12 that include a heat pump system 10 or other refrigerant-based thermal exchange system 14.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A laundry appliance comprising:

a blower that directs process air along an airflow path;

a condensing heat exchanger that heats the process air to define heated process air;

a drum for receiving the heated process air to dry laundry;

a pump that directs fluid along a fluid path;

an evaporating heat exchanger that cools the fluid to define a cooled fluid;

a refrigerant circuit that directs a refrigerant between the condensing and evaporating heat exchangers; and a shower area in which the cooled fluid is showered through the heated process air after the heated process air exits the drum to wash particulate matter out of the heated process air; wherein the pump directs the fluid towards the evaporating heat exchanger in order to cool the fluid, and directs the cooled fluid to the shower area;

the fluid path receives the particulate matter via the shower area and recirculates the fluid and the particulate matter through the fluid path; and the fluid and the particulate matter are unfiltered within the fluid path.

2. The laundry appliance of claim 1, wherein in response to interaction between the heated process air and the cooled fluid in the shower area, the heated process air is dehumidified and cooled by the cooled fluid and the cooled fluid is heated by the heated process air.

3. The laundry appliance of claim 2, wherein the fluid leaving the shower area carries moisture and the particulate matter from the process air and through the fluid path toward a fluid tank and the evaporating heat exchanger.

4. The laundry appliance of claim 3, wherein the fluid, the moisture and the particulate matter are removed from the fluid tank to a drain.

5. The laundry appliance of claim 2, wherein the interaction of the fluid and the process air leaving the drum is defined by a fluid sprayer that delivers the fluid through the process air leaving the drum to wet the particulate matter within the shower area.

6. The laundry appliance of claim 1, further comprising:

a refrigerant circuit that directs a refrigerant between the condensing and evaporating heat exchangers.

7. The laundry appliance of claim 1, wherein the airflow path and the process air are free of direct engagement with the evaporating heat exchanger and the fluid path and the fluid are free of direct engagement with the condensing heat exchanger.

8. The laundry appliance of claim 1, wherein the fluid is directed from the shower area to the evaporating heat exchanger through force of gravity.

9. An air-handling system for an appliance, the air-handling system comprising:

an airflow path that directs process air through a condensing heat exchanger to define heated process air that is delivered through a rotating drum;

a fluid path that selectively directs a fluid through an evaporating heat exchanger to define cooled fluid, wherein the evaporating heat exchanger is in thermal communication with the condensing heat exchanger; and a shower area defined by an intersection of the airflow path and the fluid path;

wherein:

the cooled fluid is delivered through the heated process air within the shower area to cool and dehumidify the heated process air and warm the cooled fluid;

the cooled fluid washes particulate matter from the heated process air;

the heated process air increases a fluid temperature of the cooled fluid; and the fluid path receives the particulate matter via the shower area and recirculates the fluid and the particulate matter in an unfiltered state through the fluid path.

10. The air-handling system of claim 9, wherein the condensing heat exchanger is free of direct contact with the fluid and the evaporating heat exchanger is free of direct contact with the process air.

11. The air-handling system of claim 9, further comprising:

a refrigerant circuit that selectively delivers a refrigerant between the condensing and evaporating heat exchangers, the refrigerant circuit including a compressor and an expansion device.

12. The air-handling system of claim 9, wherein the heated process air moved through the rotating drum is adapted to extract moisture from wet items disposed within the rotating drum to define moisture-laden process air that is selectively delivered to the shower area.

13. The air-handling system of claim 12, wherein the shower area includes the shower area adapted to direct the cooled fluid through the moisture-laden process air; and the cooled fluid is adapted to condense and remove the moisture from the moisture-laden process air.

14. The air-handling system of claim 9, wherein the evaporating heat exchanger is disposed within a fluid tank that is in communication with the shower area.

15. The air-handling system of claim 9, wherein the fluid is directed from the shower area to the evaporating heat exchanger through force of gravity.

16. The air-handling system of claim 9, wherein interaction of the fluid and the process air leaving the rotating drum is defined by a fluid sprayer disposed within the shower area that delivers the fluid through the process air leaving the rotating drum to wet the particulate matter.

17. A laundry appliance comprising:

a blower that directs process air along an airflow path;

a heater that heats the process air to define heated process air;

a drum for receiving the heated process air to dry laundry;

a pump that directs fluid along a fluid path;

a cooler that cools the fluid to define a cooled fluid;

a heat-exchange circuit that directs a thermal exchange media between the heater and the cooler; and a shower area in which the cooled fluid is directed through the heated process air after the heated process air exits the drum to wash particulate matter out of the heated process air;

wherein:

the pump directs the fluid towards the cooler in order to cool the fluid, and directs the cooled fluid to the shower area;

the fluid path receives the particulate matter via the shower area and recirculates the fluid and the particulate matter through the fluid path; and the fluid and the particulate matter are unfiltered within the fluid path.

18. The laundry appliance of claim 17, wherein the cooler is an evaporating heat exchanger and the heater is a condensing heat exchanger, wherein the heat-exchange circuit delivers the thermal exchange media through the condensing and evaporating heat exchangers.

19. The laundry appliance of claim 17, wherein the shower area includes a fluid sprayer that defines selective interaction of the fluid and the process air to wet the particulate matter.

20. The laundry appliance of claim 17, wherein the fluid leaving the shower area carries moisture and the particulate matter from the process air and through the fluid path toward a fluid tank and the cooler.

* * * * *